US011589645B2

(12) United States Patent
Horvath et al.

(10) Patent No.: US 11,589,645 B2
(45) Date of Patent: Feb. 28, 2023

(54) VARIABLE REFLEX FOOTWEAR TECHNOLOGY

(71) Applicant: Biopods Inc., Uxbridge (CA)

(72) Inventors: Steve Horvath, Uxbridge (CA); Roy Gardiner, Claremont (CA)

(73) Assignee: Biopods Inc., Uxbridge (CA)

( * ) Notice: Subject to any disclaimer, the term of this patent is extended or adjusted under 35 U.S.C. 154(b) by 56 days.

(21) Appl. No.: 16/700,110

(22) Filed: Dec. 2, 2019

(65) Prior Publication Data

US 2020/0170335 A1 Jun. 4, 2020

Related U.S. Application Data

(60) Provisional application No. 62/774,469, filed on Dec. 3, 2018.

(51) Int. Cl.

| | |
|---|---|
| ***A43B 7/1455*** | (2022.01) |
| ***A43B 13/12*** | (2006.01) |
| ***A43B 13/28*** | (2006.01) |
| ***A43B 13/38*** | (2006.01) |
| *A43B 13/14* | (2006.01) |

(52) U.S. Cl.

CPC ..... *A43B 13/12* (2013.01); *A43B 7/146* (2013.01); *A43B 13/28* (2013.01); *A43B 13/38* (2013.01); *A43B 13/14* (2013.01)

(58) Field of Classification Search

CPC ..... A43B 13/12; A43B 13/00; A43B 13/14; A43B 3/12; A43B 3/122; A43B 3/126; A43B 3/128; A43B 7/146

USPC ..... 36/11.5, 30 R; D2/916

See application file for complete search history.

(56) References Cited

U.S. PATENT DOCUMENTS 2,081,655 A * 5/1937 Adams ..... A43B 3/126 36/140
2,220,534 A * 11/1940 McLean ..... A43B 3/124 36/11.5

(Continued)

FOREIGN PATENT DOCUMENTS

DE 202017101310 5/2017

OTHER PUBLICATIONS

European Extended Search Report dated Nov. 8, 2022 in corresponding EPO Application No. 19892540.6 (7 pages).

(Continued)

*Primary Examiner* — Marie D Bays
(74) *Attorney, Agent, or Firm* — K&L Gates LLP

(57) ABSTRACT

The present disclosure provides a footwear technology system including a multilayer shoe sole system. The multilayer shoe sole insert can include a lower outsole layer, a midsole layer, and an upper insole layer, wherein the midsole layer includes a plurality of pins extending from the bottom surface of the midsole layer, wherein the pins engage with the pin holes in the outsole layer. The system can include a dynamic upper foot retention system that moves in harmony with the foot's optimal natural movement. The dynamic upper foot retention system can include a top component connecting the lace area to the sole system, and back component that connects the upper heel area to the sole system, wherein when the laces are tightened, the force is directed towards the heel securing the foot to the shoe without forcing the arch down or constricting the raising of the foot arch.

14 Claims, 10 Drawing Sheets

(56) References Cited

U.S. PATENT DOCUMENTS 4,020,569 A * 5/1977 Fukuoka ..... A43B 1/0045 36/29
4,271,608 A * 6/1981 Tomuro ..... A43C 15/165 36/127
4,316,333 A * 2/1982 Rothschild ..... A43B 7/142 36/50.1
4,616,431 A * 10/1986 Dassler ..... A43B 13/181 36/28
D350,223 S * 9/1994 Buckner ..... D2/916
5,561,919 A * 10/1996 Gill ..... A43B 3/12 36/11.5
5,619,809 A * 4/1997 Sessa ..... A43B 7/06 36/28
6,389,714 B1 * 5/2002 Mack ..... A43C 15/14 36/100
7,523,566 B2 * 4/2009 Young-Chul ..... A43B 13/12 36/28
7,797,856 B2 * 9/2010 Andrews ..... A43B 13/14 36/30 R
7,823,299 B1 * 11/2010 Brigham ..... A43B 3/105 36/101
7,926,205 B2 * 4/2011 Amark ..... A43C 15/14 36/61
8,656,610 B2 * 2/2014 Baucom ..... A43C 15/14 36/61
8,756,834 B1 6/2014 Halberstadt et al.
9,554,620 B2 * 1/2017 Cross ..... A43B 13/04
2007/0011911 A1 1/2007 Clark et al.
2007/0283594 A1 * 12/2007 Sink ..... A43B 3/122 36/11.5
2008/0250673 A1 * 10/2008 Andrews ..... A43B 13/186 36/25 R
2008/0271341 A1 11/2008 Amark
2010/0077635 A1 * 4/2010 Baucom ..... A63B 71/12 36/61
2011/0192056 A1 * 8/2011 Geser ..... A43B 13/26 36/114
2015/0128452 A1 * 5/2015 Hull ..... A43B 13/37 36/103
2018/0140041 A1 5/2018 Comstock et al.
2018/0303197 A1 * 10/2018 Chen ..... A43B 13/188
2019/0297995 A1 * 10/2019 Loveder ..... A43B 13/12

OTHER PUBLICATIONS

Chinese Office Action dated Oct. 13, 2022 in corresponding Chinese Application No. 201980090285.3 (10 pages).

* cited by examiner

VARIABLE REFLEX FOOTWEAR TECHNOLOGY

BACKGROUND OF THE INVENTION

The present subject matter relates generally to footwear technology that promotes optimal neuromusculoskeletal function in the feet, legs, hips, and back.

Mass production of footwear began in the mid to late 1980's. Since then, there has been an ever-increasing percentage of shoe-wearing populations who experience foot-related problems. Since mass production of footwear began, those conversant in the art of footwear design and manufacture have relied on the erroneous hypotheses that the vast majority of people's feet are inherently unstable or their low limbs poorly aligned due to a genetic predisposition, and that this instability and poor alignment are the cause of the vast majority of foot-related problems and pain commonly observed. As a result, footwear designers and manufacturers have tried to develop products or footwear designs that are designed to mitigate the symptoms of these problems. To this end, virtually all historical and modern footwear designers have focused on developing technologies and products which artificially control, support, and or cushion the feet to "correct" alignment and improve comfort. Due to the limitations of historical science, what the conventional footwear designers and manufacturers have failed to understand is that the problems that they are observing are actually caused by conventional footwear, especially footwear that artificially supports, cushions, and restricts foot movement.

Advancements in science have identified that long-term support and cushioning of the body are outdated concepts and no longer recommended by healthcare professionals because they cause the body to become weaker and less capable. Yet surprisingly, modern footwear, insole, and orthotic products are still influenced by support and cushioning design theories that were first introduced over 100 years ago. While footwear and footwear products that incorporate such support and cushioning may provide some temporary benefit, over the long-term the products actually cause the body to weaken, become more prone to injury, and increasingly dependent on support and cushioning.

Recent scientific advancements have identified that the body's neuromusculoskeletal functional capabilities are constantly adapting to, and are determined by, how the body is used on a daily basis. With respect to gait-related activities, the body's skeletal system, soft tissue systems, and neurological systems synergistically adapt in response to everyday use in accordance with the laws of physiology. The neuromusculoskeletal systems' functional robustness adapts towards "optimal health" when the systems are challenged to do their job. An example of this adaptive dynamic is observed in people who engage in regular exercise and experience an overall benefit to their physical health. This healthy adaptive concept is the foundation of virtually all modern rehabilitation and sports training programs. Conversely, the neuromusculoskeletal systems' functional robustness adapts towards "poor health" when the systems are not challenged to do their job and or there is a lack of use. In this instance, over time, the systems' functional maladaptation can become the conditioned norm. An example of this maladaptive dynamic is observed in people who fail to engage in regular exercise and experience an overall decrease in their physical health, and a predisposition of illness and injury.

Every moment that a person wears shoes, they are training lower limb and back neuromusculoskeletal function, either positively or negatively. Therefore, to appreciate the novelty of the invention described herein, the physiological processes that are critical to "healthy" optimal neuromusculoskeletal gait mechanics must be understood.

Optimal "healthy" neuromusculoskeletal gait-related mechanics are typically and almost exclusively observed within habitually barefoot populations who walk and run on natural terrain. This is because, when walking or running barefoot on natural terrain, the nerve endings in the soles of the feet provide the brain with the critical sensory information that is required to trigger "healthy" protective reflex muscle activations throughout the feet, legs, hips and back.

The soles of the feet contain a vast number of specialized sensory receptors called nociceptors which are activated by potentially noxious stimuli. Nociception refers to processes by which the central nervous system (brain) receives and responds to the signals from the nociceptors. Nociception is critical to the physiological process by which the body tissues are protected from harm. During optimal neuromusculoskeletal barefoot gait on natural terrain, nociceptor nerve endings in the soles of the feet pick up the subtle variations in terrain (texture and orientation) as undampened nociceptive stimulus and transmit this information to the brain. The brain synergistically uses this nociceptive stimuli, in concert with proprioceptive (spatial orientation) stimuli received from throughout the feet, ankles, legs, hips, and back, and stimuli received from the other senses (such as sight and balance) to initiate protective reflex muscle activations throughout the lower limbs and back such that they are capable of safely and efficiently managing the three-dimensional forces generated during every day and athletic gait-related activities. During barefoot gait, from step-to-step, there are different nociceptive sensory experiences, which inform the brain on the relative intensity of the activity-related forces encountered during ground contact, and that the terrain encountered during each step is varied from step-to-step. As a result, the brain remains "alert" to potential terrain variances and must anticipate them and forces that will be experienced during each progressive next step's "unknown" ground contact. To protect the lower limbs and back from harm at and during ground contact, the brain initiates lower limb and back protective reflex muscle activations, before each foot contacts the ground. These protective reflex muscle activations ensure that the lower limbs and back are capable of safely and efficiently managing the activity and terrain-related forces and stresses created during ground contact. When barefoot, the foot is unfettered and thus there is no restriction to this protective reflex activated optimal musculoskeletal movement, which requires the synergistic rising and falling of the arches and toes.

In addition, in natural barefoot gait, the soft tissue of the sole of the foot encompasses the foot's dense boney structure. When the foot is on the ground the soft tissue conforms with the ground surface, producing a contact patch sufficient to maintain traction on a wide range of surfaces. Stimuli to the soles of the feet during natural barefoot gait also cause the soft tissue of the soles of the feet to adapt to become more robust. This adaptive, robust, soft tissue padding protects the soles of the feet from the terrain and the more sensitive internal tissues of the feet from harmful stress.

Therefore, optimal healthy neuromusculoskeletal gait-related mechanics is observed in barefoot populations because their soles of their feet receive undampened sensory stimulus ("Right Stimulus") and, their feet are unencumbered which allows for uninhibited movement ("Right Movement").

Maladapted neuromusculoskeletal mechanics are typically observed within individuals who habitually wear conventional footwear, and or use products that support or cushion the feet. When shod, cushioned, and or supported the nociceptors in the soles of the feet aren't sufficiently activated because they are unable to pick up the subtle variations in terrain (texture and orientation) and thus tactile nociceptive stimulus from the ground is dampened. As a result, the brain fails to receive the sensory information required to initiate the protective muscle activations throughout the lower limbs that are required to safely manage the dynamic forces generated by the demands of three-dimensional activities. Furthermore, most conventional footwear also fetters optimal healthy dynamic musculoskeletal movement by restricting the natural synergistic rising and falling of the arches and toes. In addition, when cushioned, the soft tissues of the soles of the feet aren't challenged to produce robust protective tissue padding. Cushioning not only causes a cessation of robust soft tissue production, it causes the existing soft tissue to atrophy. As a result, the soles of the feet become increasing more sensitive and, when barefoot, incapable of effectively protecting the soles of the feet from the terrain and the more sensitive internal tissues of the feet from harmful stress.

When a shod, cushioned, supported, and restricted foot receives "poor stimulus" and or "right movement" is inhibited, the body's neuromusculoskeletal function will maladapt. Over time, this maladapted "unhealthy" neuromusculoskeletal function will become the norm and predispose the lower limb and back to injury, and it is the leading cause of most foot-related pathologies and pain.

Conventional footwear products have been promoted in the marketplace with claims that their products mimic "barefoot" like gait dynamics, by incorporating thinner or more flexible cushioning midsoles/outsoles/uppers and or by providing "static" stimulus to the soles of the feet. Note: anything that contacts the sole of the foot during gait will produce a stimulus which, depending upon the quality of the stimulus, will positively or negatively affect the muscle activity that controls the alignment of the body's skeletal system. Unfortunately, the designers of these so-called "barefoot-like" products have failed to understand and/or integrate the Right Stimulus and Right Movement principles of optimal neuromuscular gait mechanics. Most significantly, these products inhibit optimal neuromuscular gait because they still create repetitive unvaried attenuated stimulus, step after step, which, as per the laws of physiology, the brain ultimately tunes out and stops responding to, and they restrict the pre ground contact "Right Movement" raising of the toes and arches.

Footwear manufacturers commonly make "barefoot-like" shoes with thin non-cushioning midsole/outsoles made from dense rubber or rubber-like materials. While these products facilitate a greater range of variable stimulus, the dense materials don't conform with the terrain like the skin and soft tissue of the bare foot, resulting in a stiffer contact patch with the ground. The stiffer contact patch causes the shoes to lose traction on slippery surfaces. In addition, the denser materials have little or no insulating properties and transfer heat and cold to the feet easily. Furthermore, while the midsole/outsoles of these types of shoes provide more varied stimuli, most of their upper designs still restrict "Right Movement", as noted above and, therefore, inhibit optimal neuromuscular gait mechanics.

Accordingly, there is a need for a footwear technology that creates "Right Stimulus" and facilitates "Right Movement."

BRIEF SUMMARY OF THE INVENTION

The present disclosure provides a footwear technology system including variable reflex technology. Various examples of the systems and methods are provided herein.

The present disclosure provides a footwear technology system including a multilayer shoe sole system. The multilayer shoe sole insert can include a lower outsole layer, a midsole layer, and an upper insole layer. The midsole and/or outsole can conform with the terrain to mimic barefoot-like stimulus to the soles of the feet. A variable reflex technology pod can be located in the arch section of the upper insole layer in order to provide subtle, varied stimulus to the soles of the feet's arch areas.

The midsole layer can include a thin pliable sheet body of denser material than the outsole layer, wherein the midsole layer includes a plurality of pins extending from the bottom surface of the midsole layer, wherein the pins engage with pin holes in the outsole layer.

The system can include a dynamic upper foot retention system that moves in harmony with the foot's optimal natural movement. In an example, the dynamic upper foot retention system includes a top component and back component.

The arch component connects the lace area to the sole system, wherein the arch component can be fixed to the sole system at two points: the underside of the back of the heel, and the arch area of the sole. As such, the arch component creates a floating lacing area, wherein when the laces are tightened, the force is directed towards the heel securing the foot to the shoe without forcing the arch down or constricting the raising of the foot arch.

The heel component of the foot retention system can connect the upper heel (achilles tendon insertion) area of the foot to the sole system, wherein the back component can be comprised of a flexible, yet inelastic material, (e.g., synthetic fiber, molded plastic, die-cut plastic, or combinations thereof, among others). The heel portion is affixed to the sole system at two points: the underside of the middle of the arch areas, and the shoe upper at the back of the heel. As a result, the heel portion provides a floating resistance to the forces on the foot generated by tightening the laces of the shoe.

The arch component and heel component of the foot retention system move independently from each other while dynamically securing the shoe to a user's foot.

An advantage of the present system is that the components interact in harmony with the foot's natural dynamic movement. In other words, the system provides optimal synergistic rising and falling of the arch and toes, as stimulated by the sole system.

A further advantage of the present system is providing a foot retention system that allows for tightening of the laces of the shoe without compressing a user's arch.

Another advantage of the present system is mimicking the optimal neuromusculoskeletal dynamics of the barefoot gait by providing subtle varied nociceptive stimulus to the soles of the feet, an optimal ground contact patch for enhanced traction, and unfettered natural foot movement (i.e., optimal protective reflex response).

Another advantage of the present system is providing technology receptive to subtle varied stimulus. However, the reference to nociceptive and proprioceptive stimulus eliciting a protective reflex response is not limited to harsh stimulus, but rather the brain and neuro-network is more alert, attentive, and responsive to subtle varied stimulus.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities, and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1A:
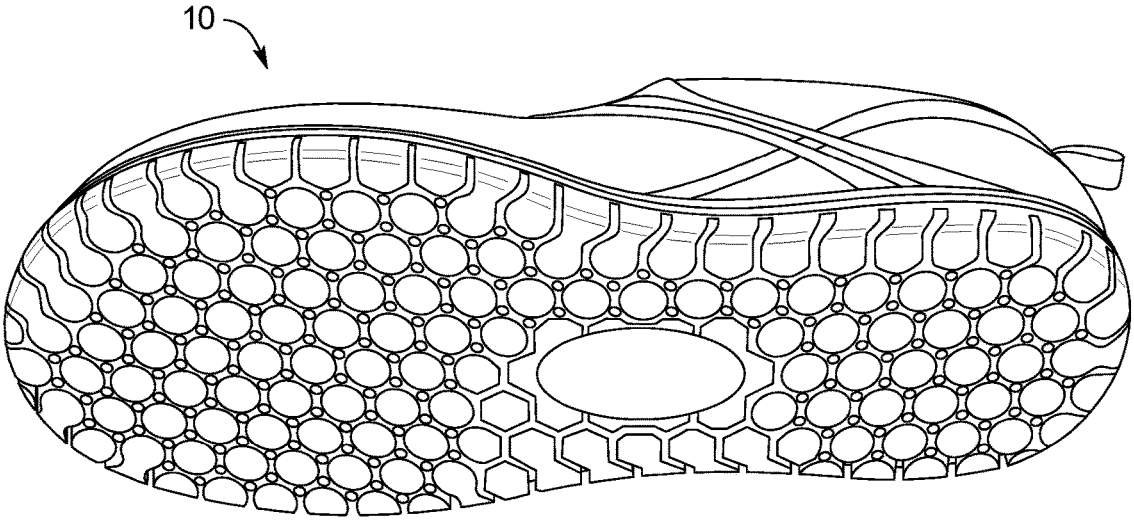
FIGS. 1A-1C include a schematic of an exploded view and perspective views of an example of the footwear technology system disclosed herein.
Figure 1B:
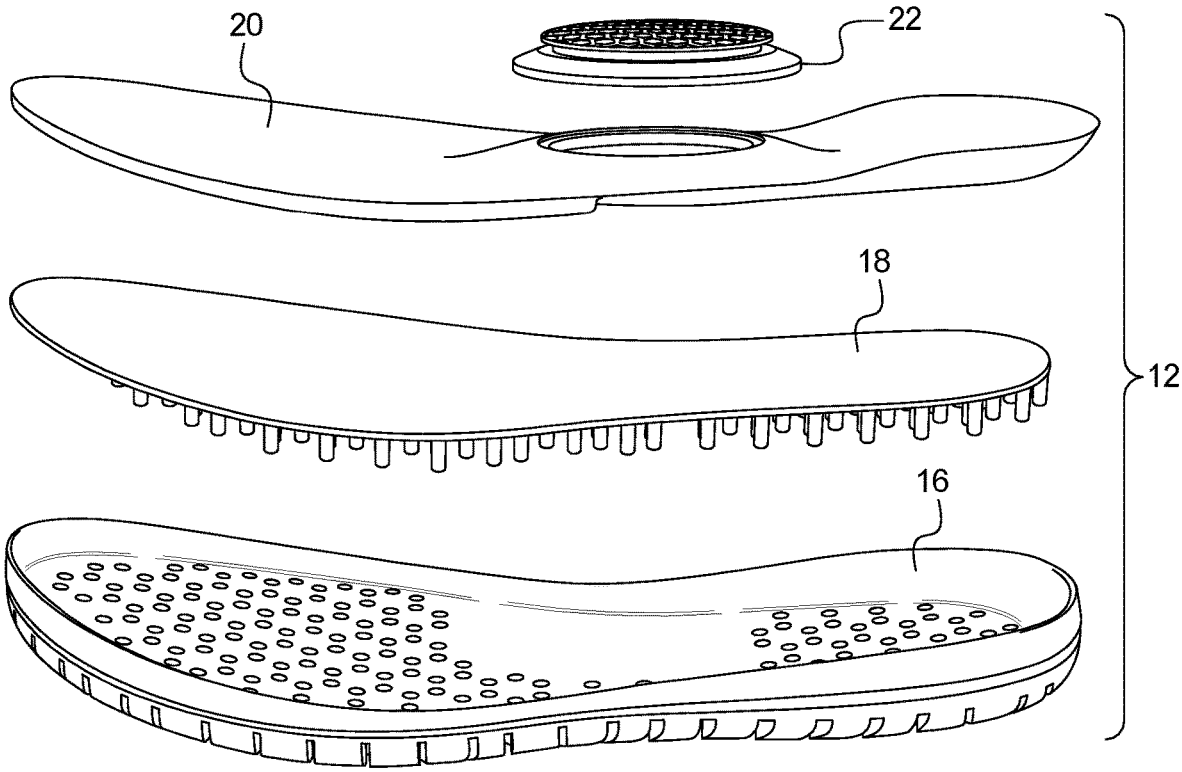
Figure 1C:
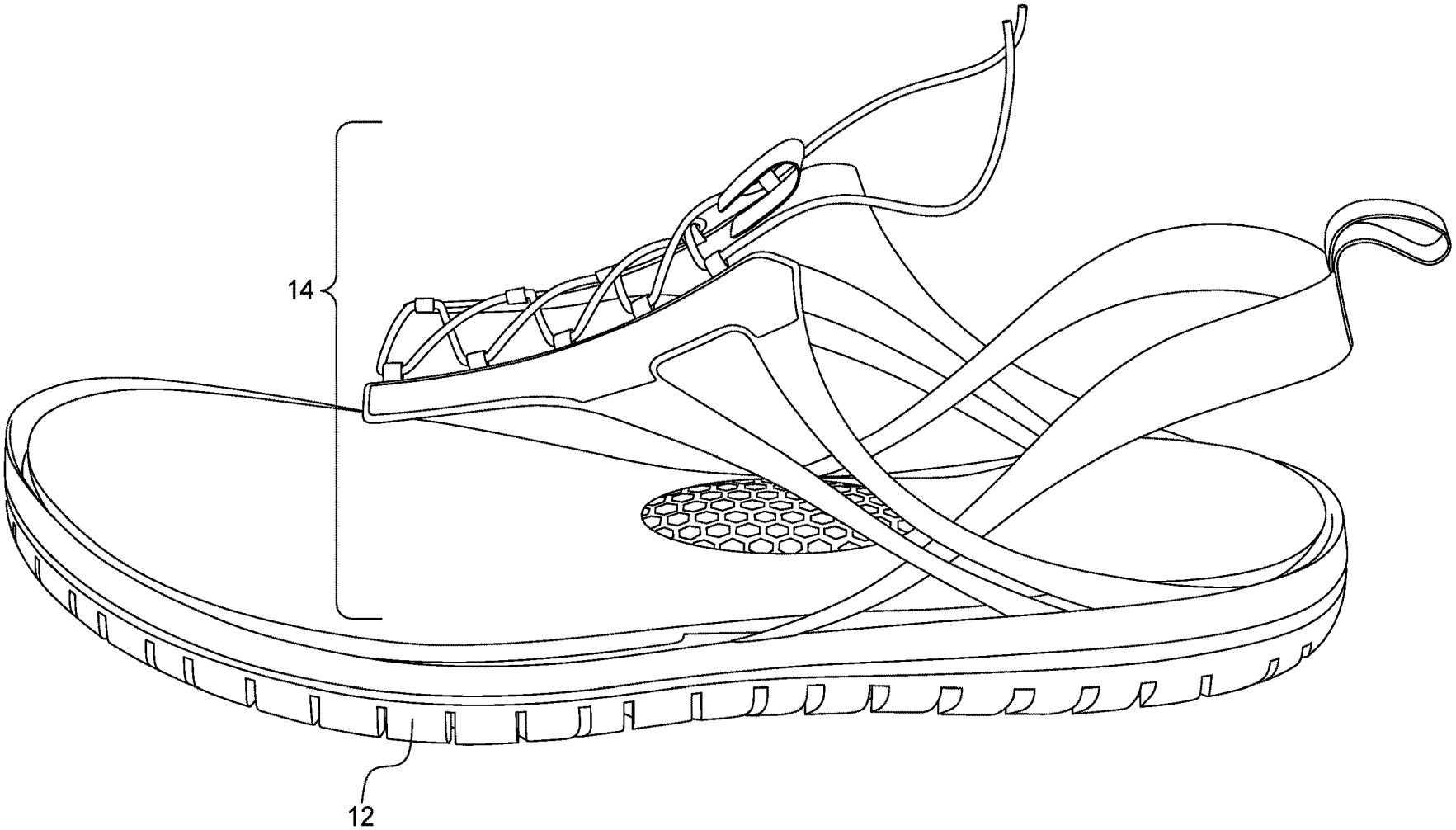
Figure 2A:
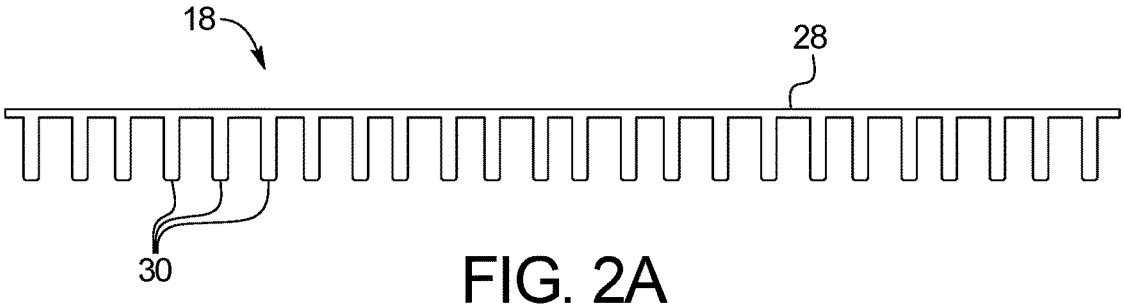
FIGS. 2A-2D are side views of an example the pin configuration of the midsole.
Figure 2B:
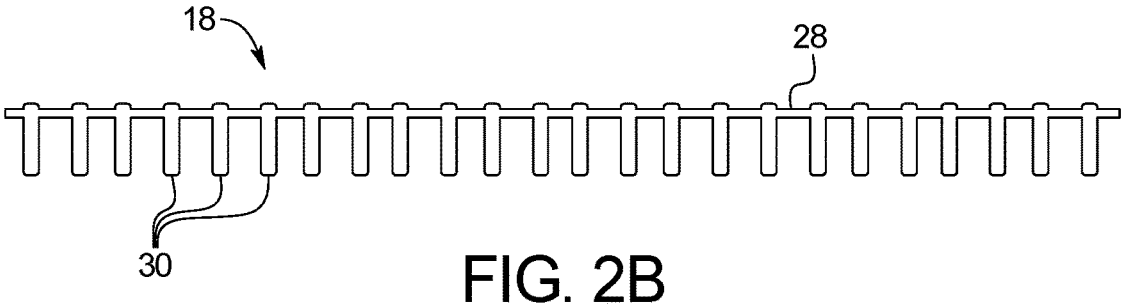
Figure 2C:
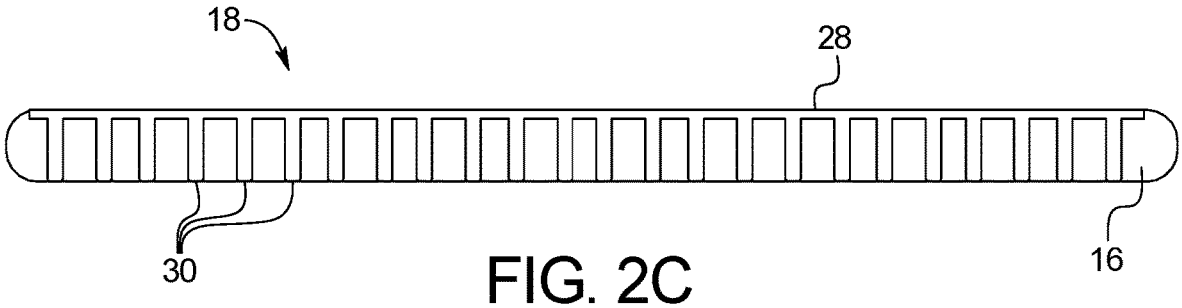
Figure 2D:
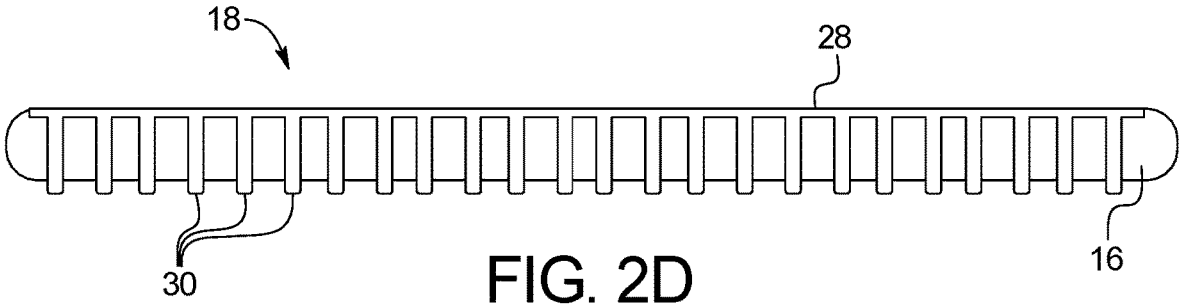
Figure 5:
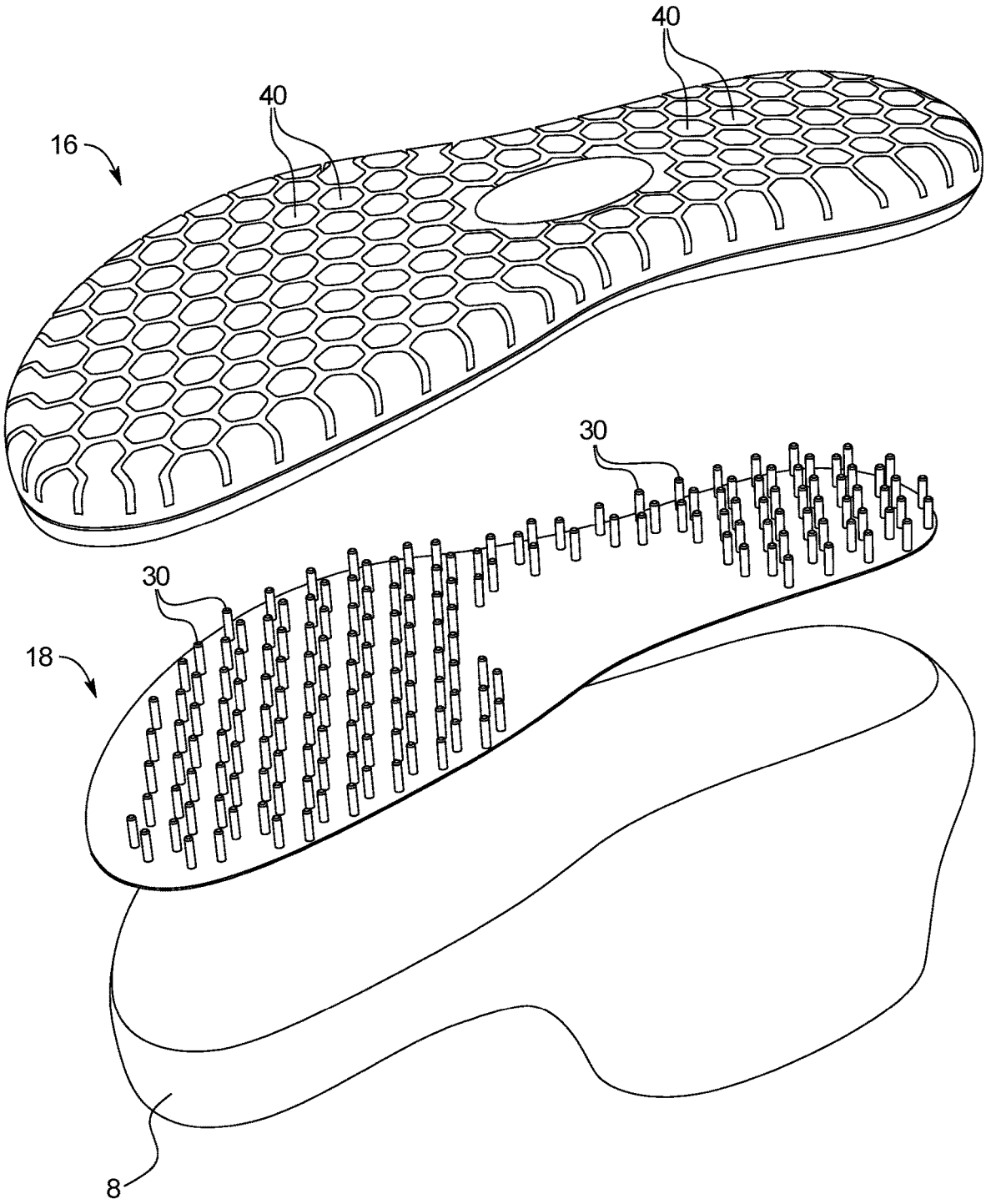
FIG. 5 is a side view of an exploded view of an example of the midsole and outsole layers.

As shown in FIGS. 1A-1C, the present footwear technology system 10 includes a multilayer sole system 12 and a dynamic upper foot retention system 14, wherein the system 10 can be used in conjunction with a shoe body 8, as shown in FIG. 5.

Figure 4:
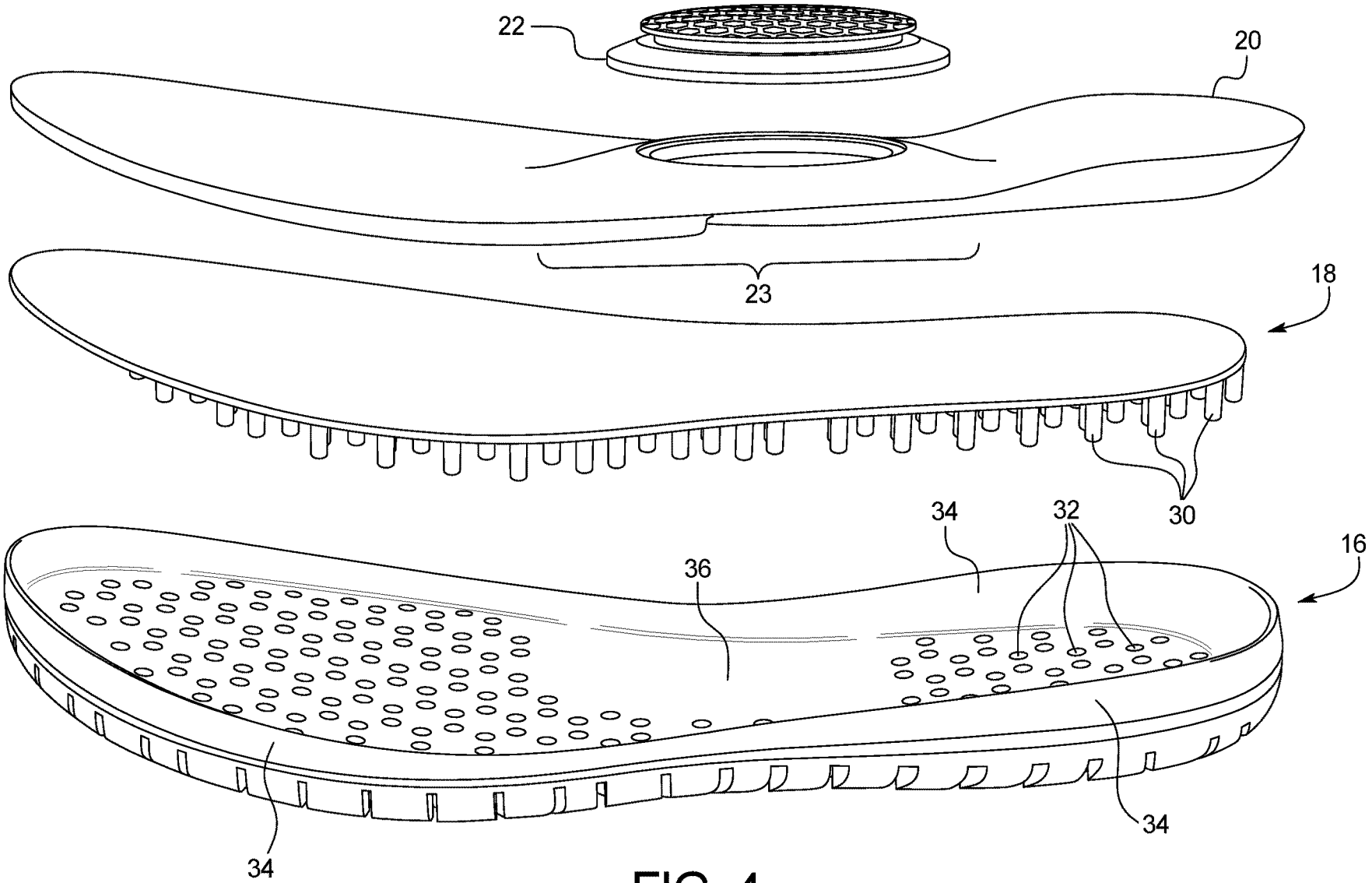
FIG. 4 is an exploded view of an example of the multilayer sole system.

The multilayer shoe sole system 12 can include a lower outsole layer 16, a midsole layer 18, and an upper insole layer 20. The sole system can conform with the terrain to mimic barefoot-like stimulus to the soles of the feet. As shown in FIG. 4, a variable reflex technology pod 22 can be located in the arch section 23 of the upper insole layer 20 in order to provide subtle, varied stimulus to the soles of the feet's arch areas.

As shown in FIGS. 2A-2D, the midsole layer 18 can include a thin pliable sheet body 28 of denser material than the outsole layer 16, wherein the midsole layer 18 includes a plurality of pins 30 extending from a bottom surface of the sheet body 28 of the midsole layer 18, wherein the pins 30 engage with the pin holes 32 in the outsole layer 16.

The pins 30 and corresponding pin holes 32 can be of any suitable shape including, but not limited to, cylinders, cubic, rectangular, among others. The plurality of pins can be the same height, same diameter, varying heights, and/or varying diameters. As shown in FIGS. 2A-2D, the pins 30 of the midsole upper 18 surface can have a variety of configurations with the outsole layer 16. In an example, the pins 30 may extend past the upper surface of the sheet body 28 of the midsole layer 18. In an example, the pins 30 may not extend past the upper surface of the sheet body 28 of the midsole layer 18, but are flush with the upper surface of the midsole layer 18. In an example, the pins 30 may extend past the bottom surface of the outsole layer 16. In an example, the pins 30 may not extend past the bottom surface of the outsole, but extend through the outsole layer 16 such that the pins are flush with the bottom surface of the outsole layer 16.

In an example, the pins 30 may be recessed from the bottom surface of the outsole layer 16. In an example, the pins 30 may extend through the outsole layer 16 and be of a variety of different lengths as a specific application may require, with some pins 30 being recessed from the bottom surface of the outsole layer 16, some pins 30 being flush with the bottom surface of the outsole layer 16, and some pins 30 extending 16 past the bottom surface of the outsole layer 16.

Figure 6A:
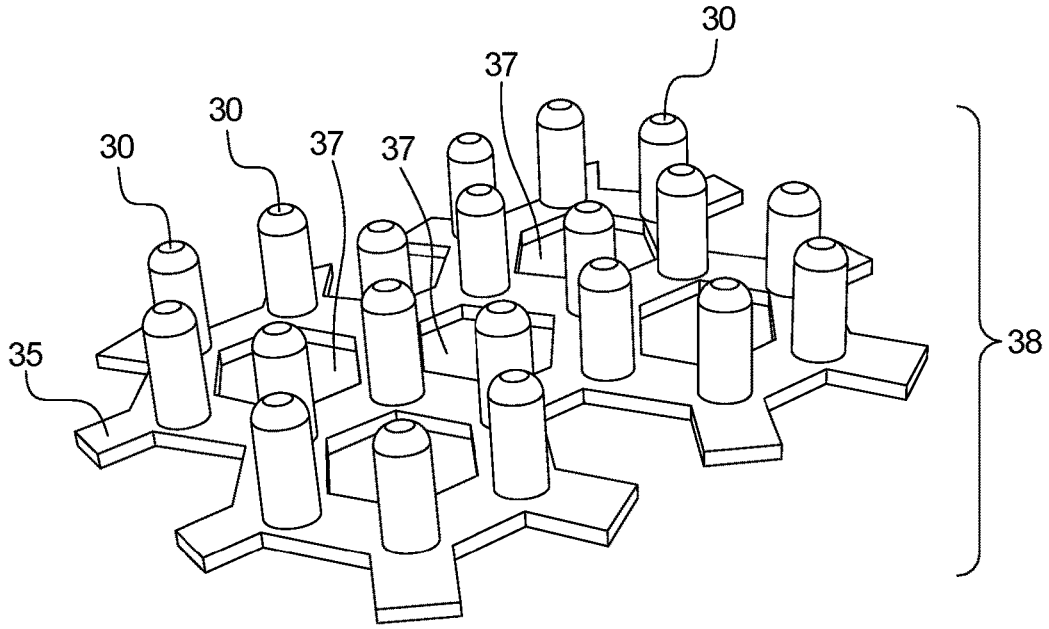
FIG. 6A-6C are perspective views of a molded pin assembly and a molded honeycomb assembly used in conjunction to form the outsole layer.

Alternatively, as shown in FIG. 6A, the midsole layer 18 can include a molded pin assembly 38 including a plurality of pins 30 of denser material than the outsole layer 16, wherein the molded pin assembly 38 includes a plurality of pins 30 extending from a bottom surface of the sheet body 28 of the midsole layer 18, wherein the pins 30 engage with the pin holes 32 in the outsole layer 16.

Alternatively, or in addition to, the system can include a mobile pin configuration such that the design incorporates a structure around the base of the pin that allows the collective pins to move more independently from the body of the midsole and/or outsole layer. As a result, the system allows for a more varied stimulus.

Figure 3:
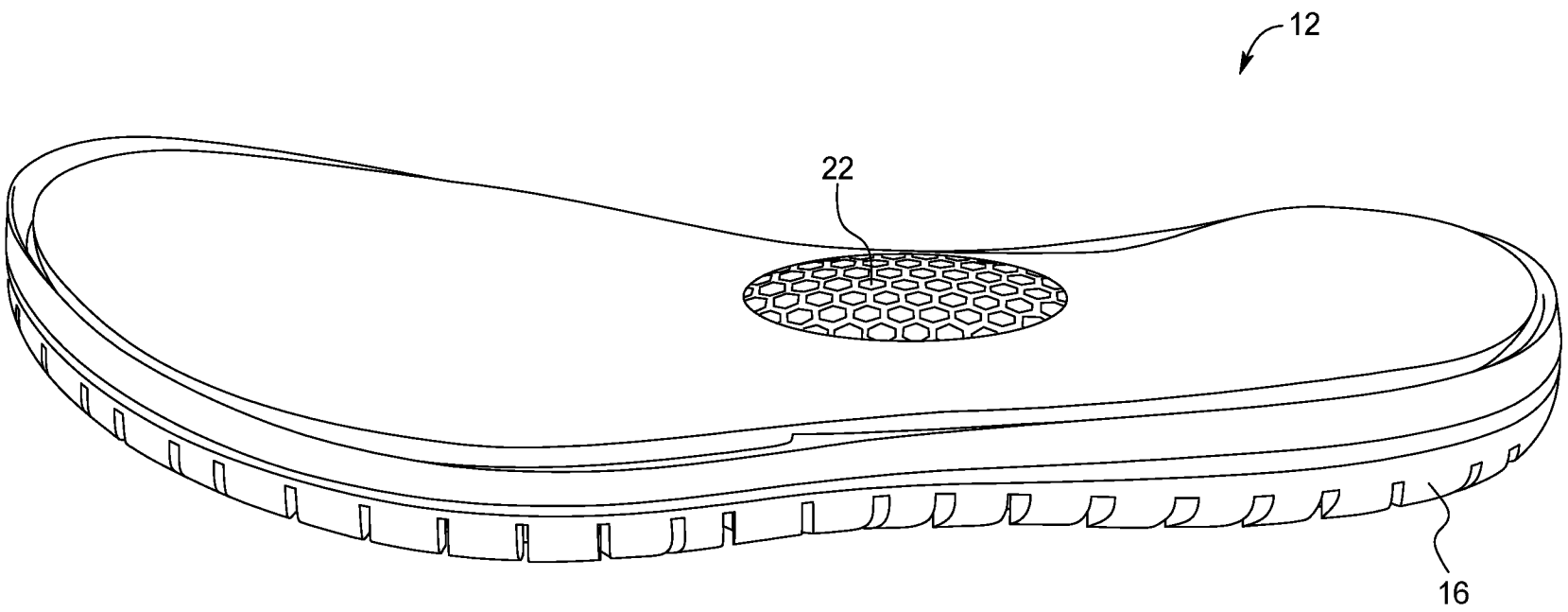
FIG. 3 is a perspective view of an example of the multilayer sole system disclosed herein.

As shown in FIGS. 3-4, the flexible outsole layer 16 of the multilayer shoe sole system 12 can include vertical perforations 32 extending through a portion of the outsole layer 16. The outsole layer 16 can include a raised rim 34 around the perimeter of a base body 36 that defines a cavity to receive the midsole layer 18. Alternatively, or in addition to, the flexible outsole layer 16 can include a molded upper surface cavity that is defined to receive the molded pin assembly 38, such that the molded pin assembly 38 fits flush with the upper surface of upper surface of the outsole layer 16. As shown in FIG. 5, the base of the outsole layer 16 can include a recurring geometrical three-dimensional tread structure 40 (e.g., honeycomb configuration). Although the honeycomb configuration is used as the predominant example, it should be understood the outsole layer 16 can include any recurring three-dimensional tread shape including, but not limited to, hemispherical shapes (e.g., circular or oval), rectangular shapes, cylindrical, trapezoidal, triangular shapes, pentagram cylinders, among others, and combinations thereof. In other words, the outer surface of the base body 36 can include a tread structure 40 configuration of any adjacent shapes.

A feature of the tread structure 40 is the combination of their material softness, size, orientation positioning, and spacing to allow for an even flexing of the midsole layer 18 and outsole layer 16 combination in all directions, especially in the forefoot area. If the combination of the midsole layer 18 and outsole layer 16 materials is too hard (i.e., given any foot size, the midsole layer 18 and outsole layer 16 combination become stiff and resist easy uniform flexing), in combination of the treads structure 40 being too large (i.e., the midsole layer 18 and outsole layer 16 combination do not flex uniformly), or not oriented optimally, or their spacing too great (i.e., the midsole layer 18 and outsole layer 16 combination do not flex uniformly), rigid non-uniform flex lines can be created that do not align optimally with the user's ball of the foot (metatarsal heads), which, as a result, can cause discomfort or bruising of the ball of the foot.

Figure 6B:
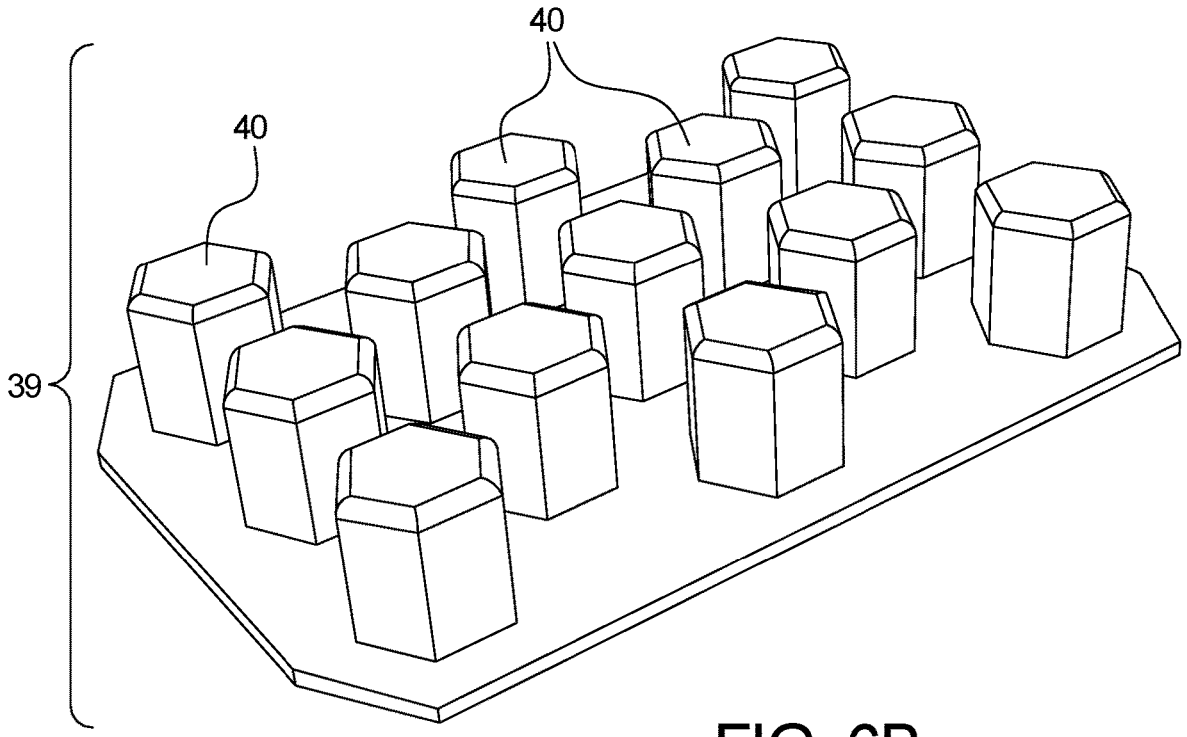
Figure 6C:
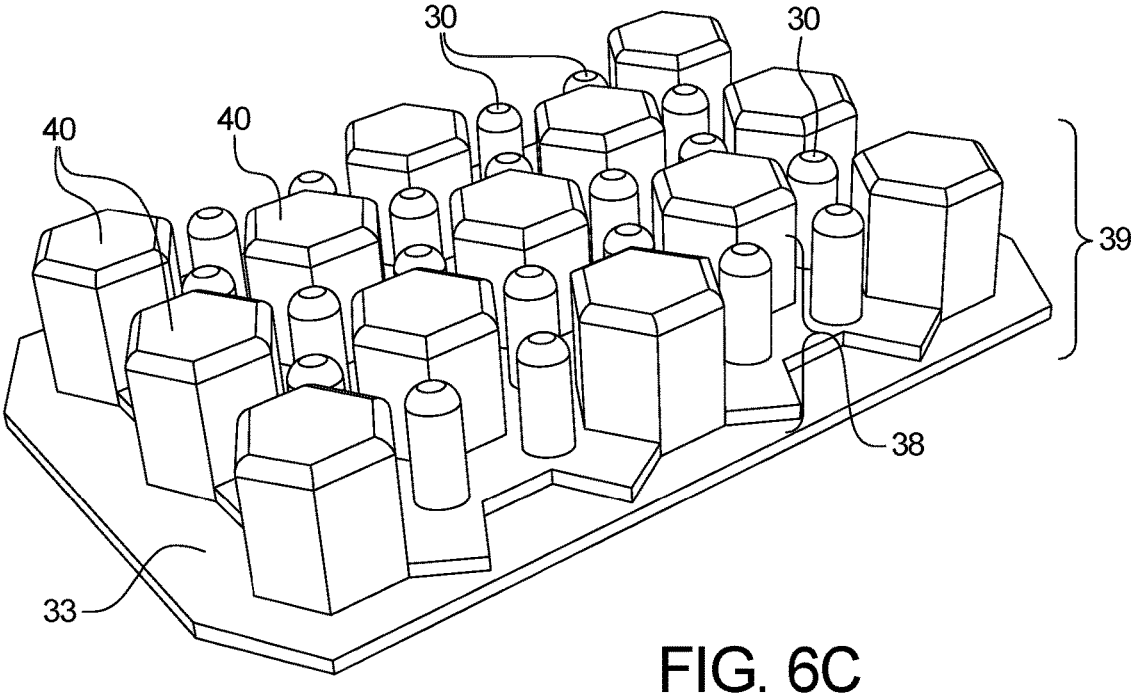

As shown in FIGS. 6A-6C, the system can include an outsole including a molded pin assembly 38 including a plurality of pins 30 and a molded honeycomb assembly 39 including a plurality of tread structures 40, wherein the molded pin assembly 38 can fit with the molded honeycomb assembly 39 such that the tread structures 40 slide through the openings in the pin assembly 38 resulting in an outsole layer 16 with pins placed between the honeycomb structures 40. For example, the molded pin assembly 38 can include a pin base surface 35 including a plurality of honeycomb openings 37, wherein the pins 30 extend from the pin base surface 35. The molded honeycomb assembly 39 can include a honeycomb base surface 33, wherein the tread structures 40 extend upward from the honeycomb base surface 33. The molded pin assembly 38 can be positioned with the molded honeycomb 39 assembly by sliding the molded pin assembly 38 onto the molded honeycomb assembly 39 wherein the honeycomb structures extend up through the openings in the molding pin assembly 38. In an example, the molded pin assembly 38 can be fit with the molded honeycomb assembly 39 via a pressure fit, adhesive, snaps, hinges, among other connectors. The pin structures can be small enough in circumference to allow for slip fit assembly against the corresponding holes in the pin assembly.

Figure 7:
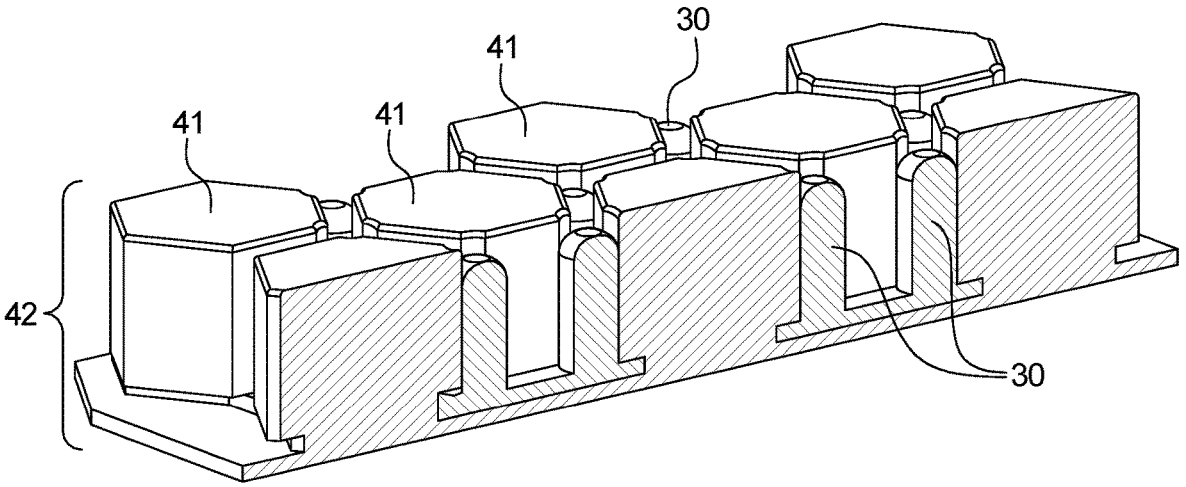
FIG. 7 is a side view and cross-sectional view, respectively, of the molded pin assembly engaged with the molded honeycomb assembly.

As shown in FIG. 7, in an example, once the molded pin assembly 38 and the molded honeycomb assembly 39 are engaged with each other, the engaged assembly can be placed into a second molding process, wherein the second molding would incorporate a foam injection process to over-mold the engaged assembly. The over-molding process can incorporate honeycomb cavities that would correspond in position to the treads 40 but with a larger cavity body than the treads 40 in the initial assembly. During the over-molding process, the treads 40 would be expanded to fill the larger cavity space, creating larger tread structures 41, effectively trapping the molded pin assembly 38 within the larger tread structures 41.

The second molded configuration 42 of the molded pin assembly 38 engaged with the molded honeycomb assembly 39 has numerous advantages including the fact that the outsole layer 16 may be sealed such that water cannot enter any holes or openings in the outsole layer 16. Further, the tread structures 41 (and larger tread structures 41) can be fully supportive yet have a flexible mobility to prevent over stiffness. The second molding process eliminates having holes in any of the foam parts, which results in less tooling issues. Instead of the outsole layer 16 including a plurality of pin holes, the second molding configuration 42 can include large honeycomb holes 37 in the pin assembly 38 making the tooling easier and seal improved. Standard tooling and equipment can be used for the second molding configuration, which results in time and cost efficiency. Further, the honeycomb assembly can be fully encapsulated by foam such that less heat is lost in winter footwear.

Figure 8:
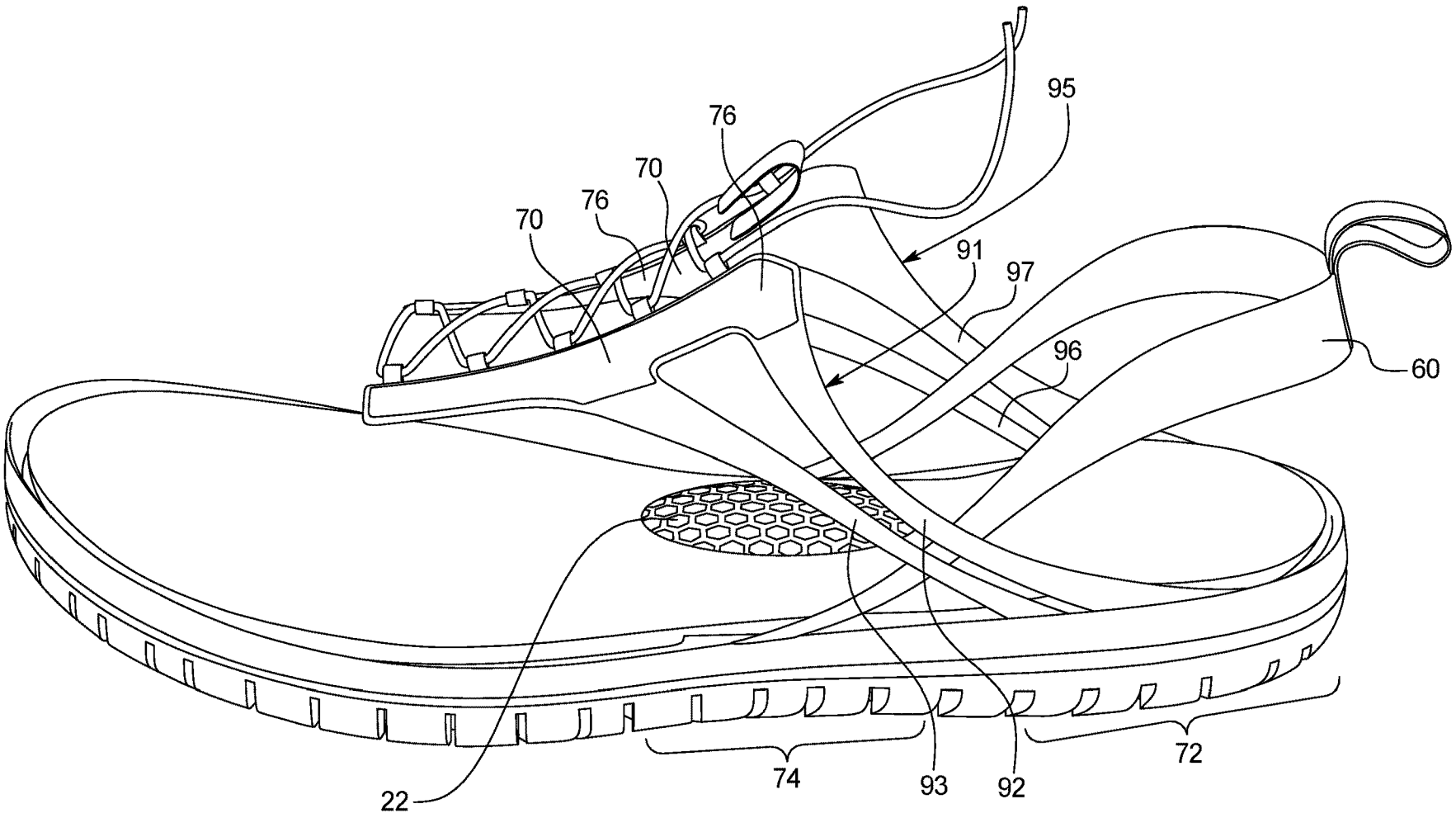
FIG. 8 is a side view of the upper dynamic foot securing system in conjunction with the multilayer sole system.

As shown in FIG. 8, the system can include an arch pod 22 positioned on and/or within the arch area of the insole layer 20 or midsole layer 18. The arch area can be the area posterior to the foot's metatarasal heads (forefoot) and anterior to the foot's heel and centered close the side to side mid-line of the foot. The arch pod 22 can provide subtle, varied stimulus to the soles of the feet's arch area. The arch pod 22 can be circular and/or ovular. The arch pod can be a symmetrical or asymmetrical dome type shape, wherein the arch pod is compatible with the shape of a user's arch area.

The design of the arch pod 22 is such that as the weight-bearing foot transitions from initial ground contact through leaving the ground, the foot's weight-bearing forces at the arch area cause the arch pod to dynamically deform. The dynamic deformation produces varied intensities, surface area locations, and surface area volumes of rebound compression resistance to the arch area of the user's feet. The arch pod 22 can be spring-like in providing subtle varied rebound compression resistance, wherein with a minimum amount of force the arch pod will easily flatten. The subtle varied rebound compression resistance can create a subtle varied nociceptive stimulus to the soles of the feet that the brain requires for optimal muscle activation. The arch pod 22 can be made of any suitable resilient deformable materials that can rebound immediately to their original shape and continue to do so after many deformations. In an example, the arch pod 22 can be made of a soft deformably resilient thermoplastic elastomer or rubber materials that may or may not be foamed.

The outsole layer 16, midsole layer 18, and insole layer 20 can be made of any suitable materials. In an example, the outsole layer 16 can be made of a soft, flexible poly-(ethylene-vinyl acetate) (EVA), polyurethane, rubber, foamed thermoplastic elastomers (TPE), among other polymeric blends that form a pliable ground contact interface for enhanced traction. The soft deformable outsole material can conform with the ground surface while progressively compacting with increased loads, which increases the loads on the pins. The system can include a footwear body forming an outer wall of the shoe. The footwear body can be made of any suitable material including, but not limited to, fabric, waterproof material, elastic material, among others.

In an example, the midsole layer 18 can be made of a flexible thermoplastic rubber, thermoplastic polyurethane, among other polymeric blends that provide a denser material than that of the outsole. The midsole layer pins directly transmit the ground surface variations and related forces to the sole of the foot as the softer outsole layer compacts and deforms with increased loads, thereby providing the subtle varied nociceptive stimulus required for healthy protective reflex function. The thin flexible characteristics of the midsole layer 18 allows for the unfettered natural foot movement and optimal traction due to the midsole material's traction dynamics when the pins contact the ground.

However, it should be understood that the exact materials of the midsole and outsole can be independently selected depending on the intended use of the footwear (e.g., indoor, outdoor, artificial turf, natural grass, trails, running, walking, biking, hiking, etc.) and style of footwear (e.g., dress, casual, athletic, etc.). However, typically a softer outsole and stiffer midsole is advantageous.

For example, for dress shoes, casual shoes, sandals, running shoes, court shoes (e.g., basketball, tennis, etc.) the outsole treads 40 and larger tread structures 41 (e.g., honeycomb cell structure) are smaller and more compact, and the midsole pins can be located between the outsole treads, are smaller in diameter (e.g., 3-5 mm), and the length of the pins may be flush with the outsole bottom surface or 1-2 mm shorter.

In an example, for winter boots and/or hiking boots, the footwear system can include outsole tread structures 40 and larger tread structures 41 (e.g., the honeycomb cell structure) may be larger and more widely spaced, when compared to the dress and casual shoe configuration. The midsole pins 30 may be located between the outsole tread structures 40 (i.e., between each honeycomb structure) and/or centered in the outsole tread structures 40 (e.g., within the honeycomb structure). The midsole pins 30 may be slightly larger in diameter when compared to the dress and casual footwear configurations. The range of the diameters of the pins 30 and tread structures 40 and larger tread structures 41 vary proportionally by shoe size as well as application requirement. The diameters of the pins 30 and tread structures 40 and larger tread structures 41 can be determined by the pins' material characteristics (i.e., as stiffer more resilient material would be more suitable for smaller diameter pins; and a less stiff, less resilient, yet more slip resistant material would be more suitable for larger diameter pins). The length of the midsole pins 30 can have a length wherein the pins are flush with the outsole bottom surface or extend past the bottom surface of the insole surface by 1-2 mm.

In an example, such as for the intended footwear is for golfing, the outsole treads can be of similar size and spacing as compared to the dress and casual footwear configuration. The midsole pins 30 may be located between the outsole tread structures 40 or centered in the outsole tread structures 40, may be similar in diameter when compared to the dress and casual footwear configuration, and the length of the pins can extend past the outsole bottom surface by between, and including, 5-10 mm.

In an example, when the intended footwear is for use on artificial turf, the outsole treads may be similar in size and spacing, or larger in size and spacing, when compared to the dress and casual footwear configuration. The midsole pins 30 can be located in the center of the outsole treads, may be larger in diameter when compared to the dress and casual footwear configuration, and the lengths of the pins 30 can extend past the outsole bottom surface, wherein the lengths of the pins 30 can be between, and including, 3-12 mm.

In an example, such as when the intended footwear is for use on natural grass turf, the outsole treads may be larger in size and spacing when compared to the dress and casual footwear configuration. The midsole pins 30 can be located in the center of the outsole treads, can be larger in diameter when compared to the dress and casual footwear configuration, and the length of the pins 30 can extend past the outsole bottom surface by between, and including, 5-15 mm.

With respect to conventional court footwear (i.e., tennis, basketball, etc.), due to the very stiff nature of the midsoles/outsoles designs and materials used, these properties not only attenuate the nociceptive stimulus required for healthy protective reflex function, only the medial edge of the outsole contacts the hard court surface when athletes are making diagonal, cutting movements. Such limited ground contact area combined with a stiff shoe midsole/outsole can create an external to the foot pivot point, which creates the high torsional forces (and acceleration) and related damaging stresses that cause injury to the knees and ankles. Furthermore, with each step, wearers of conventional court footwear with these features will experience an increased predisposition to injury and compromised athletic performance capabilities.

When compared to conventional court footwear (i.e., tennis, basketball, etc.), the present footwear technology system 10 including the flexible midsole layer 18 and outsole layer 16, with the appropriate length and diameter of pins 30, create healthy nociceptive stimulus, create a significantly larger shoe contact patch with the ground, provide greater traction, and significantly reduce or eliminate the damaging torsional stresses that cause injury to the knees and ankles. Additional benefits of court footwear that incorporate the present system 10 are that, with each step, wearers will experience improved low limb and back function (strength and flexibility), enhanced athletic performance capability, and a reduced risk of injury.

Similarly, with respect to conventional artificial turf and natural grass footwear, due to the very stiff nature of the midsoles/outsoles required to accommodate cleats and the limited number of cleats that such design allows, when athletes are making diagonal cutting movements only one or two large cleats are digging into the ground. These properties not only attenuate the nociceptive stimulus required for healthy protective reflex function, the limited cleat contact combined with the midsole/outsole stiffness creates a pivot point which results in the high torsional forces (and acceleration) that create the related damaging stresses that cause injury to the knees and ankles. Furthermore, with each step, wearers of conventional artificial turf and natural grass footwear with these features will experience an increased predisposition to injury and compromised athletic performance capabilities.

When compared to conventional natural grass and artificial turf footwear, the present system 10 of flexible midsole layer 18 and outsole layer 16, with a higher number of cleats/pins, create healthy nociceptive stimulus, create a significantly larger shoe contact patch with the ground, provide greater traction, and significantly reduce or eliminate the damaging torsional stresses that cause injury to the knees and ankles. Additional benefits of natural grass and artificial turf footwear that incorporate the present system 10 are that, with each step, wearers will experience improved low limb and back function (strength and flexibility), enhanced athletic performance capability, and a reduced risk of injury.

As shown in FIG. 8, the system 10 can include a dynamic upper foot retention system 14 that moves in harmony with the foot's optimal natural movement. In an example, the dynamic upper foot retention system 14 includes a top component 70 and back component 60.

The dynamic upper foot retention system 14 connects the lace area to the sole system 12, wherein the top component 70 can be fixed to the sole system 12 at the underside of the back of the heel 72, and wherein the back component 60 can be connected to the sole system 12 at the midfoot area 74 of the sole system 12. As such, the top component 70 creates a floating lacing area 76, wherein when the laces are tightened, the force is directed towards the heel securing the foot to the shoe without forcing the foot arch down or constricting the raising of the foot arch. The material of the top component 70 can be synthetic fiber, molded or die cut plastic, stiff non-stretch textile, stiff leather, plastic applique that may be heat molded onto the shoe upper material, or combinations thereof.

The back component 60 of the foot retention system 14 can connect the upper posterior heel area of the foot to the sole system 12, wherein the back component 60 of the foot retention system can be comprised of a flexible, yet inelastic material, (e.g., synthetic fiber, molded plastic, die-cut plastic, or combinations thereof, among others). The back component 60 can be affixed to the sole system 12 at the underside of the midfoot areas 74. As a result, the back component 60 provides a floating resistance to the forces on the foot generated by tightening the laces of the shoe. In an example, the back component 60 can be a single strap that connects the right side of the sole system 12 to the left side of the sole system 12, wherein the back component 60 wraps around the user's heel area, for example, around the upper posterior heel area of the footwear.

The top component 70 and back component 60 of the foot retention system 14 move independently from each other while dynamically securing the shoe to a user's foot. As a result, the tightening of the laces does not compress the arch of the user's foot.

The top component 70 can include or connect to a lace housing 76 to receive the laces of the shoe used to secure the footwear body to the user's foot. The lace area can include two sides wherein the laces are engaged with each side. The top component 70 can include a right lateral strap 91 connected the right lateral side of the lace area to 76 the right lateral side of the sole body 12 approximately at the front of the user's heel area. The right lateral strap 91 can include one or more straps, for example, a first right lateral strap 92 can connect to a first end of the right lateral side of the lace area, and a second right lateral strap 93 can connect to a second end of the right lateral side of the lace area 76. A left medial strap 95 of the top component 14 can connect the left side of the lace area 76 to the sole system 12 at the front area of a user's inner arch area. The left medial strap 95 can include one or more straps, for example, a first left medial strap 95 can connect to a first end of the left medial side of the lace area 76, and a second left medial strap 96 can connect to a second end of the left medial side of the lace area 76. The right lateral strap 91 and left medial strap 95 can connect to the sole system 12 wherein the straps can be secured within the layers (e.g., between the insole layer 20 and midsole layer 18, or between the midsole layer 18 and the outsole layer 16).

Figure 9:
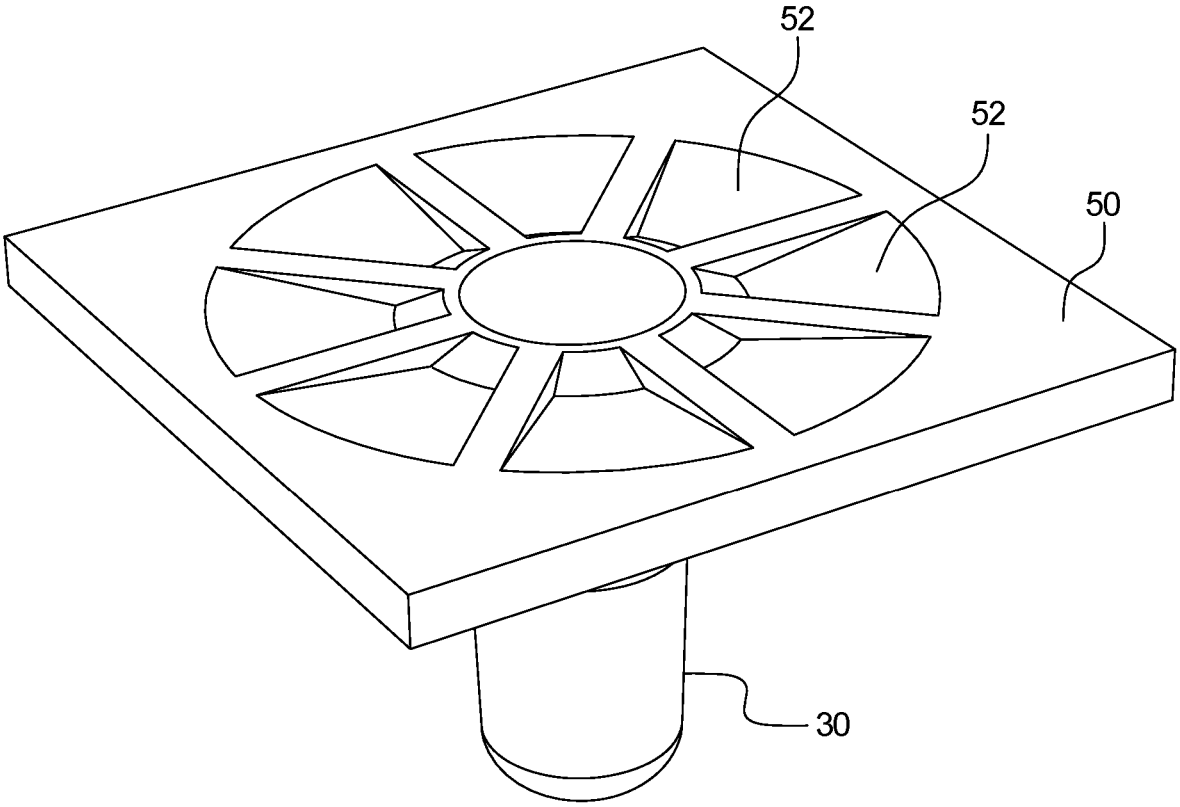
FIG. 9 is perspective views of the pin disclosed herein.

FIG. 9 illustrates a perspective view of a pin 30 that can be used in the multilayer sole system 12. The pins 30 can be a cylindrical extension from a base 50 perpendicular to the cylindrical portion. The base 50 can be any suitable shape. The base 50 can include a square shape including a plurality of indentions 52 radiating from the point of attachment of the cylindrical portion.

The shape of the pins 30 can be such that, depending on their material properties, deform minimally during body weight loading, and provide non-slip properties or traction enhancing properties as may be required for specific applications. When incorporated into a shoe, the combination of a soft outsole with a stiffer pin/base midsole mirrors the natural structural composition of the human foot which has a rigid skeleton encapsulated by soft tissue. The natural composition allows the foot's soft tissue to adapt to the natural terrain such that the soft tissue deforms to create a larger contact patch with the ground, while the skeleton maintains the overall structural integrity.

Conventional footwear constructed with a stiff outsole, a soft cushioning outsole, or cushioning midsole with stiff outsole, or cushioning insole, isolate the sole of the foot from the subtle differences in terrain (i.e., the brain doesn't get the nociceptive sensory information required for optimal lower limb, hip, and back protective reflex muscle function). In addition, conventional footwear constructed with stiff uppers, restrictive uppers, stiff inflexible outsoles and midsoles inhibits or restricts the foot's optimal natural dynamic movement (i.e., protective reflex activated dynamic raising of the toes and arches. Conventional footwear constructed with one or more of the above features cause the unhealthy maladaptive neuromusculoskeletal mechanics that lead to the vast majority of foot-related problems and pain. With each step, wearers of conventional footwear with these features will experience an increased predisposition to injury and compromised athletic performance capabilities.

In contrast with conventional footwear, in the present system 10 mimics the varied nociceptive sensory experience (Right Stimulus) that the barefoot sole of the foot receives when in contact with natural terrain, thereby providing the brain with the sensory information required for optimal healthy protective reflex lower limb, hip, and back muscle activation. In addition, the present system 10 mimics the unencumbered barefoot, healthy, dynamic, protective reflex activated foot movement (facilitates Right Movement). Additionally, with each step, wearers of footwear that incorporate the present system 10 will experience improved low limb and back function (strength and flexibility), improved athletic performance capabilities, and a reduced risk of injury.

When incorporated into a shoe, the present system's 10 multilayer shoe sole insert 12 combination of a soft outsole with a stiffer pin/midsole: allows the outsole to variably compact, in response to, and in relation to specific and varying loading areas of the feet thereby increasing the midsole pins stimulus to the soles of the feet at these varying locations; allows the multiplayer sole 12 to easily flex in all directions as the sole of the shoe adapts to the terrain, and allows the soft outsole 16 to deform to provide a larger contact with the ground while the midsole pins 18 transmit the terrain variations to the sole of the foot—in essence mimicking the ground reaction barefoot experience.

When incorporated into a shoe, the present system's 10 upper foot retention system 14 allows unencumbered protective reflex activated dynamic foot movement.

It should be noted that various changes and modifications to the embodiments described herein will be apparent to those skilled in the art. Such changes and modifications may be made without departing from the spirit and scope of the present invention and without diminishing its attendant advantages. For example, various embodiments of the systems and methods may be provided based on various combinations of the features and functions from the subject matter provided herein.

We claim:

1. A multilayer footwear sole system configured to be positioned between a user's foot and a ground surface, the multilayer footwear sole system comprising:

an outsole layer including an outsole body including a top outsole surface and a bottom outsole surface, wherein the outsole body includes a plurality of pin openings extending from the top outsole surface through at least a portion of a thickness of the outsole body, and wherein the outsole body includes a tread structure on the bottom outsole surface; and a midsole layer including a top midsole surface and a bottom midsole surface, wherein a plurality of pins extends from the bottom midsole surface, each pin having a first end at the bottom midsole surface and a second end opposite the first end;

wherein, when the midsole layer engages with the outsole layer, the plurality of pins of the midsole layer insert within the plurality of pin openings in the outsole layer;

wherein, when the midsole layer engages with the outsole layer, the plurality of pins of the midsole layer are visible in the tread structure on the bottom outsole surface; and wherein the midsole layer comprises a soft polymer material such that, when the multilayer footwear sole system is positioned between the user's foot and the ground surface, the second ends of at least a subset of the plurality of pins contacts the ground surface and correspondingly deforms a portion of the midsole layer from which the subset of the plurality of pins extends to apply localized pressure to the user's foot at the portion of the midsole layer.

2. The system of claim 1, wherein the outsole layer includes a receiving cavity defined by a shape of the midsole layer, wherein the midsole layer fits flush within the receiving cavity of the outsole layer.

3. The system of claim 1, wherein the tread structure comprises includes a plurality of honeycomb tread structures.

4. The system of claim 1, further comprising an insole layer positioned above the midsole layer.

5. The system of claim 4, further comprising an arch pod positioned on the top surface of the insole layer, wherein the arch pod is positioned at a user's foot arch.

6. The system of claim 1, further comprising a top component and a back component, wherein the top component includes a lace area of a footwear and is connected to a heel portion of the midsole layer, wherein the back component includes a single strap connecting an arch area of a first side of the midsole layer to the arch area of the second side of the midsole layer.

7. The system of claim 6, wherein the top component includes a first lateral strap and second lateral strap, wherein the lace area of the top component includes a lace area first side on the first lateral strap and a lace area second side on the second lateral strap, wherein the first lateral strap connects the lace area first side to a first side heel portion of the midsole layer, wherein the second lateral strap connects the lace area second side to a second side heel portion of the midsole layer.

8. The system of claim 1, further comprising an insole layer positioned above the midsole layer.

9. The system of claim 8, further comprising an arch pod positioned on the top surface of the insole layer, wherein the arch pod is positioned at a user's foot arch.

10. The system of claim 8, further comprising a dynamic upper foot retention system including a top component and a back component, wherein the top component connects a lace area of a footwear to a back portion of the midsole layer, wherein the back component includes a single strap connecting an arch area of a first side of the midsole layer to the arch area of the second side of the midsole layer.

11. The system of claim 10, wherein the top component includes a first strap and second strap, wherein the first strap connects a lace area first side to a first side heel portion of the midsole layer, wherein second strap connects a lace area second side to a second side heel portion of the midsole layer.

12. The system of claim 1, wherein the second ends of the plurality of pins are flush with the bottom outsole surface of the outsole body.

13. The system of claim 1, wherein the second ends of the plurality of pins are recessed from the bottom outsole surface of the outsole body.

14. The system of claim 1, wherein the second ends of the plurality of pins extend beyond the bottom outsole surface of the outsole body.

* * * * *